US005901710A

United States Patent [19]

Barber

[11] Patent Number: 5,901,710

[45] Date of Patent: May 11, 1999

[54] CIGAR ENHANCING HUMIDOR

[76] Inventor: Michael Barber, 20 S. Ridge Rd., Pomona, N.Y. 10970

[21] Appl. No.: 08/961,077

[22] Filed: Oct. 30, 1997

[51] Int. Cl.[6] ..... A24F 15/00; A24B 15/30

[52] U.S. Cl. ..... 131/274; 131/328; 131/275; 206/213.1; 206/242; 206/256

[58] Field of Search ..... 131/274, 250, 131/328, 329, 275; 206/213.1, 256, 265, 242

[56] References Cited

U.S. PATENT DOCUMENTS

| | | | |
|---|---|---|---|
| 4,832,059 | 5/1989 | Garrard et al. | 131/276 |
| 5,615,694 | 4/1997 | Battard et al. | 131/365 |

*Primary Examiner*—Stanley S. Silverman
*Assistant Examiner*—Steven B. Leavitt
*Attorney, Agent, or Firm*—Bryan, Levitin & Bab, LLP

[57] ABSTRACT

A cigar enhancing humidor is airtight and nonporous and has a flavor additive chamber which is controllable to release moisture and flavoring into the humidor which are absorbed by the cigars to enhance their flavor.

20 Claims, 5 Drawing Sheets

CIGAR ENHANCING HUMIDOR

FIELD AND BACKGROUND OF THE INVENTION

The present invention relates, in general, to humidors, and in particular to a new and useful cigar enhancing humidor which improves the flavor of cigars contained therein.

Although an important function of a humidor is to safely store tobacco products, in particular cigars, an equally important function of the humidor is to provide an appropriate environment which preserves the cigars and which can actually improve the quality of the cigars over time.

A cigar comes from the plantations and rolling factories only one way, that is substantially finished as far as the flavor and taste is concerned. Aging causes (say some) flavor to increase such as fine wine. However, most experts say that 99% of the flavor is already in the well preserved cigar and only 1% improvement could be expected from aging. The purpose of the present invention is to actively control and steer cigar flavoring in a direction never before travelled, yet keeping it enjoyable and desirable.

Cigar smoking is a feast to all the senses, taste, feel, smell, and sight. The present invention seeks to address all of these and enhance them to a point which they become more desirable than a non-enhanced cigar.

Some examples of humidor structures can be found in the prior art. U.S. Patent Des. 372,138 discloses a cigar humidor storage cabinet design. U.S. Pat. No. 4,534,369 discloses an enclosure which forms a humidor for tobacco products.

Also see U.S. Pat. No. 5,607,051 for a humidor having multiple storage compartments. U.S. Pat. No. 5,011,009 discloses a cigar storage and transportation container which has a humidor for tobacco products which creates an airtight compartment and has a removable closure.

SUMMARY OF THE INVENTION

An object of the present invention is to enhance various qualities of a cigar or other tobacco product, while in its temporary home, that is a specially designed and constructed humidor.

The invention relies on an airtight containment vessel in which cigars are placed and through absorption of contained humidified air and an enclosed ingredient bearing element, the cigars take on a new moisture content, bearing a new flavor chosen by the principal (smoker). It is estimated that the procedure takes about three to five days to occur.

The ingredient bearing elements can be designed in many ways. One example is a LUCITE containment chamber with a reservoir and a sponge contained within. LUCITE is a trademark for a transparent acrylic resin or plastic. Small holes are drilled specifically to allow evaporation to be directed toward the cigars contained within such a humidor to allow interaction between both cigar and flavor ingredient.

These flavors are typically desirable preexisting concentrates, extracts or liquors and the like. Examples are: 1) vanilla, 2) almond, 3) banana, 4) Cognac, 5) Grand Marnier, 6) Sambucca, 7) chocolate liquor, etc . . . All or any of these can be incorporated, mixed or singularly used in this interactive cigar flavoring process. The containment chamber of the present invention should only be made of a nonporous material capable of being washed with alcohol-based cleaners. A porous substance for the interior humidor walls absorbs the flavor and taints the surface permanently.

A further object of the present invention is to provide a humidor method and apparatus which increases the beneficial effects of storing tobacco products in the humidor and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
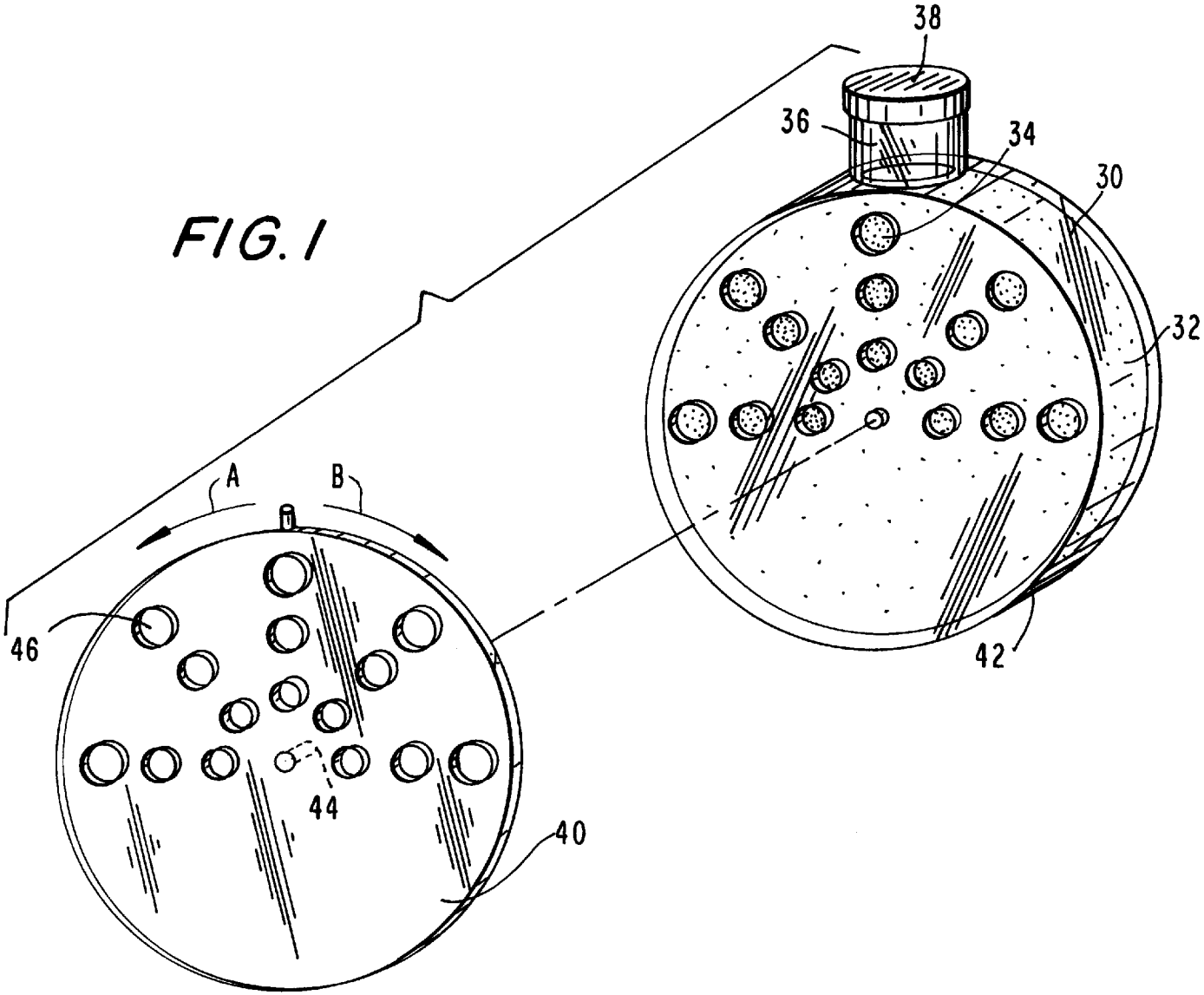
FIG. 1 is an exploded perspective view of an ingredient bearing element in accordance with the present invention.
Figure 3:
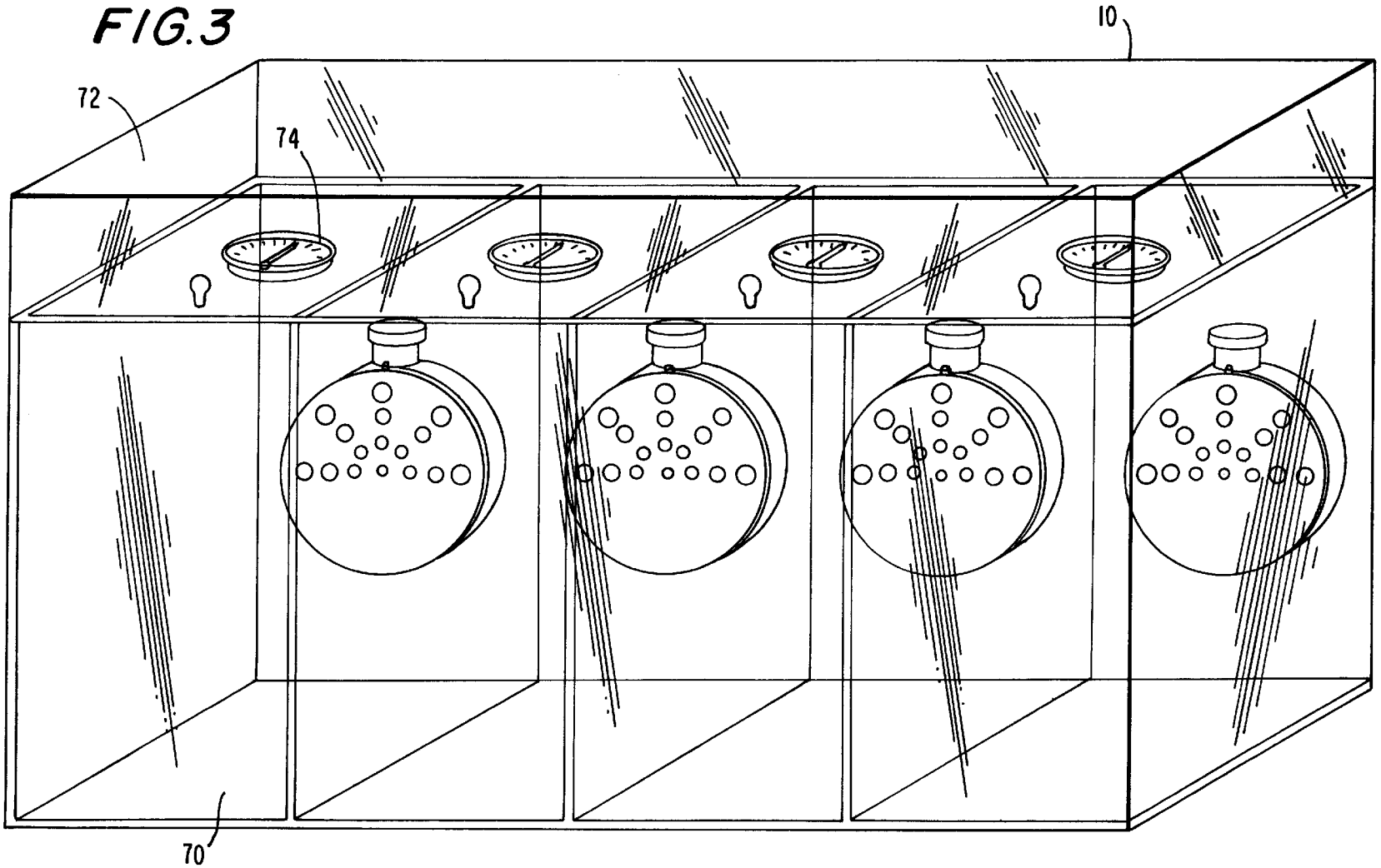
FIG. 3 is a perspective view of a humidor container in accordance with another embodiment of the invention.
Figure 5:
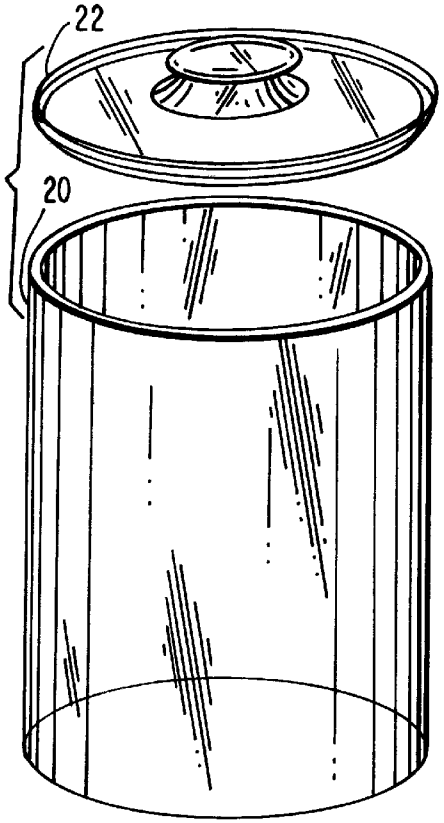
FIG. 5 is an exploded view of another container which can be used in accordance with the present invention.

Referring to the drawings in particular, the present invention comprises an air tight, nonporous humidor such as a compartmentalized box 10 shown in FIG. 3 or a cylindrical canister shown at 20 in FIG. 5, which is shaped and sized to receive a number of cigars, and which, in accordance with the present invention, also contains an additive chamber generally designated 30 in FIG. 1, which contains a sponge or other porous element or substance which can absorb liquid, generally water, plus a selected additive for flavoring the cigars such as a flavoring concentrate, extract or liquor. As noted above, examples include vanilla extract, almond extract, banana extract, Cognac, Grand Marnier, Sambucca, chocolate liquor and the like.

Chamber 30 can, for example, be a metal cylindrical can 32 having flat rear and front disk-shaped covers 42, the front cover having a pattern of perforations 34. A sponge or porous material such as porous stone fills the can 32. A cylindrical filling spout 36 is connected at the top of the cylindrical wall 32 and includes a stopper such as a cork or screw on cap 38. The cap can be removed and the water plus flavorant added to the can until the sponge is saturated. To control the release of the liquid plus extract which is sufficiently volatile to evaporate slowly over time, a cover disk 40 is pivotally mounted to the lid 42 of container 32, at a journal 44 such as a rivet or pin, which closely presses disk 40 against lid 42. A similar pattern of perforations 46, on disk 40, which is substantially the same as perforations 34 on lid 42, can be aligned or misaligned with each other by rotating disk 40 in the direction of arrows A or B, to control the apertures communicating the chamber 30 with the interior of the humidor and thus control the rate at which liquid evaporates with the additive ingredient evaporates from the sponge or porous stone, and enters the atmosphere of the humidor.

As noted above, it is important that the humidor be substantially airtight and nonporous to avoid having the flavorant absorbed into the walls of the humidor rather than into the cigars.

Figure 2:
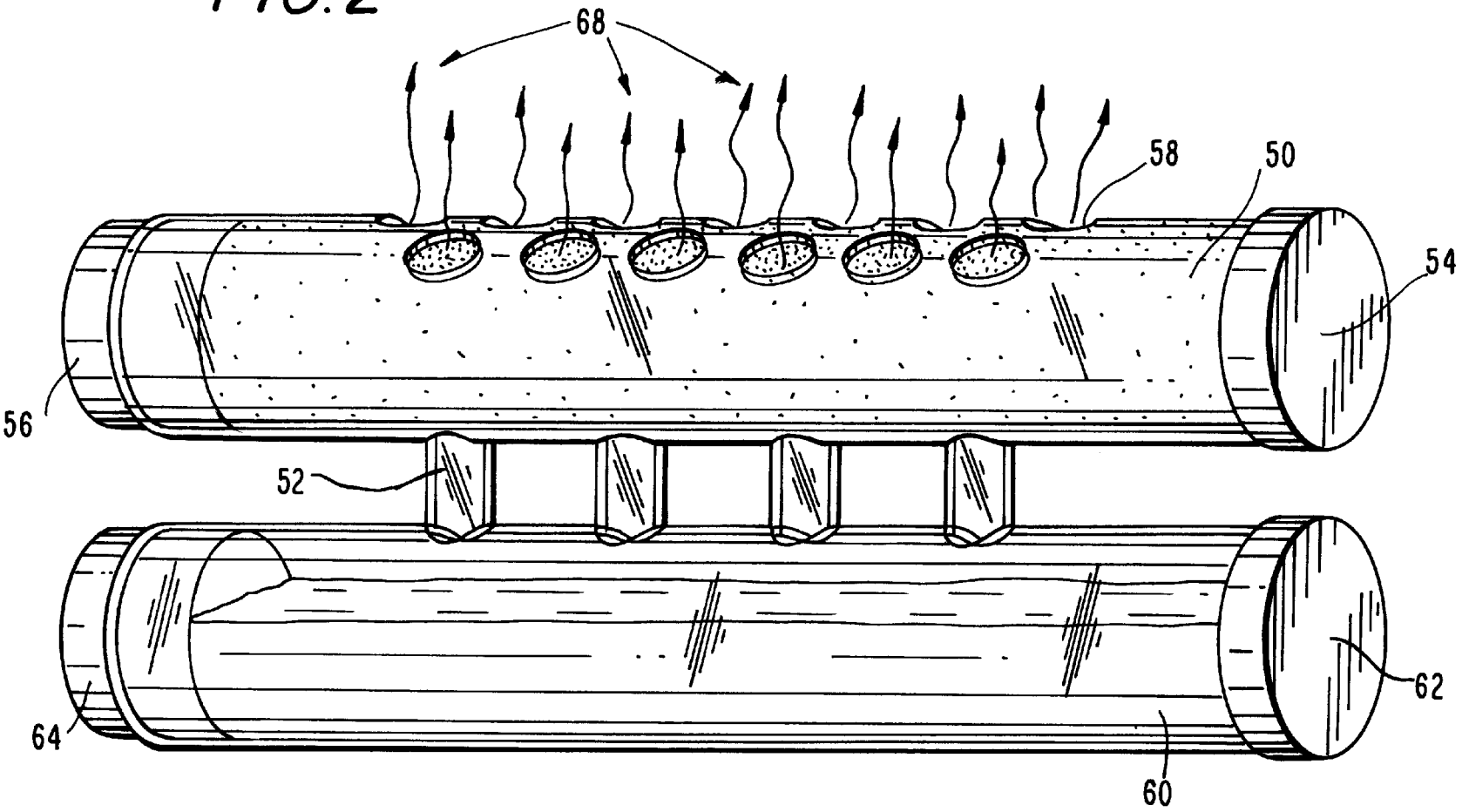
FIG. 2 is a perspective view of another embodiment of the ingredient-bearing element.

FIG. 2 illustrates a second embodiment of the invention comprising a pair of approximately 1 inch in diameter nonporous walled tubes 50 and 60 which both have cylindrical interiors that communicate with each other through a plurality, in this case four, passage tubes 52. Chamber tube 60 is closed at one end by a cap 62 and at an opposite end by a cork 64 and has solid nonperforated walls. Chamber tube 50 is closed at one end by a cap 54 and at an opposite end by a cork 56 and is perforated by a pattern of tiny holes 58 drilled through the wall of tube 50. Both chamber tubes 50 and 60 and connecting tubes 52 are advantageously made of clear plastic material (for example, LUCITE) with the upper tube 50 being filled by a sponge or liquid absorbing porous stone or other porous member. The lower reservoir tube 60 is filled with liquid flavoring and water which slowly evaporates through passage tubes 52, disperses through the sponge or porous element, and then slowly discharges through openings 58 as schematically shown by vapors 68.

FIG. 3 illustrates another embodiment of the invention where the humidor container generally designated 10 is a clear plastic box 70 having multiple individually airtight containers, each covered by a 72 or by individual lids. Each humidor compartment has its own hygrometer 74 for monitoring the humidity in each airtight container. Each container is provided for receiving one or more cigars.

Figure 4:
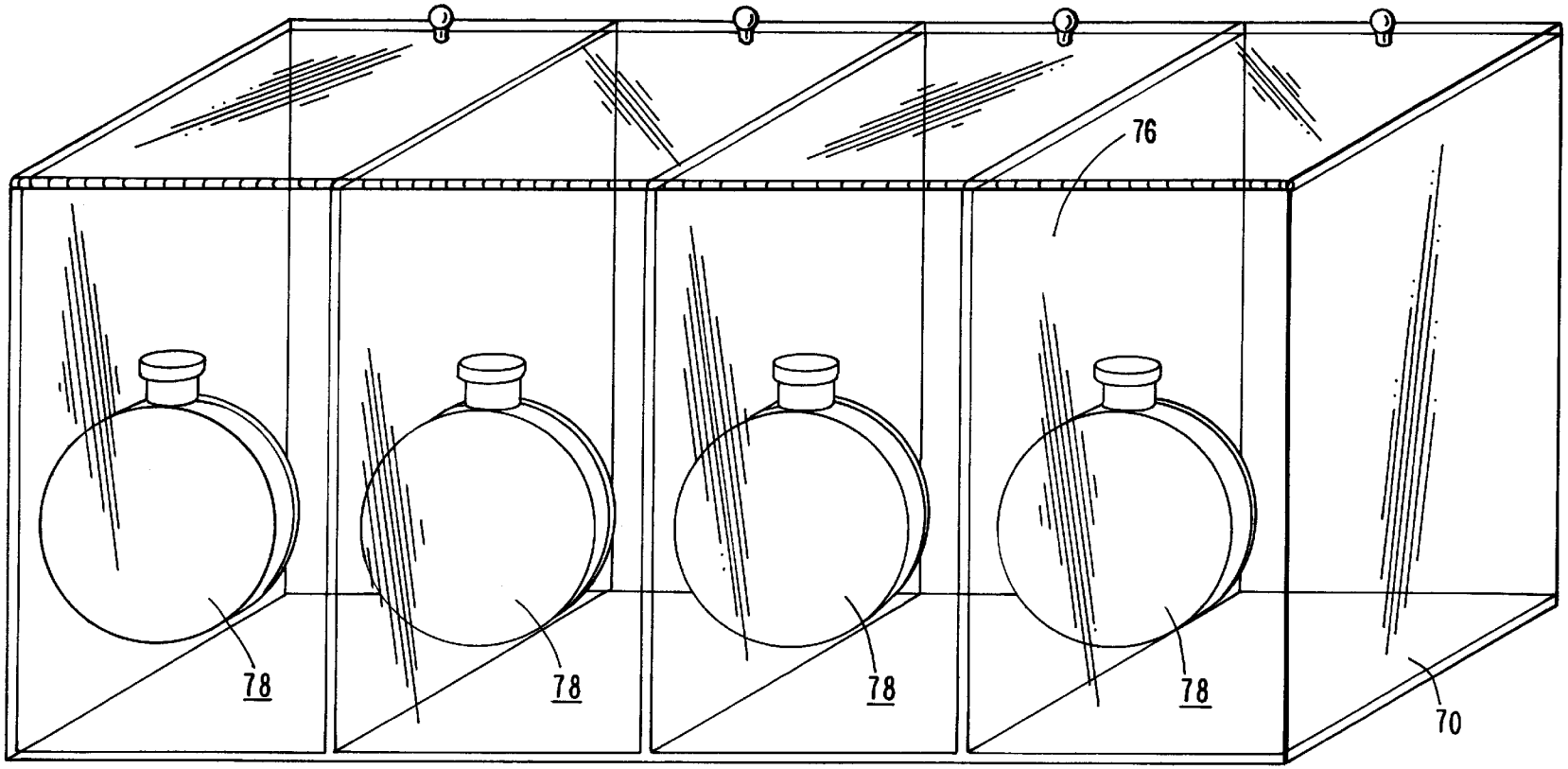
FIG. 4 is a perspective view of the rear area of the container in accordance with the present invention.

The rear wall of humidor 70 shown at 76 in FIG. 4, contains an ingredient chamber 78 for each of the individual compartments in the humidor, each constructed substantially as shown in FIG. 1. In this way, individual and different flavorings can be added to different collections of cigars, and since each chamber 78 is separately adjustable for controlling the discharge of flavoring and humidity each collection of cigars can be flavored separately and differently.

Figure 7:
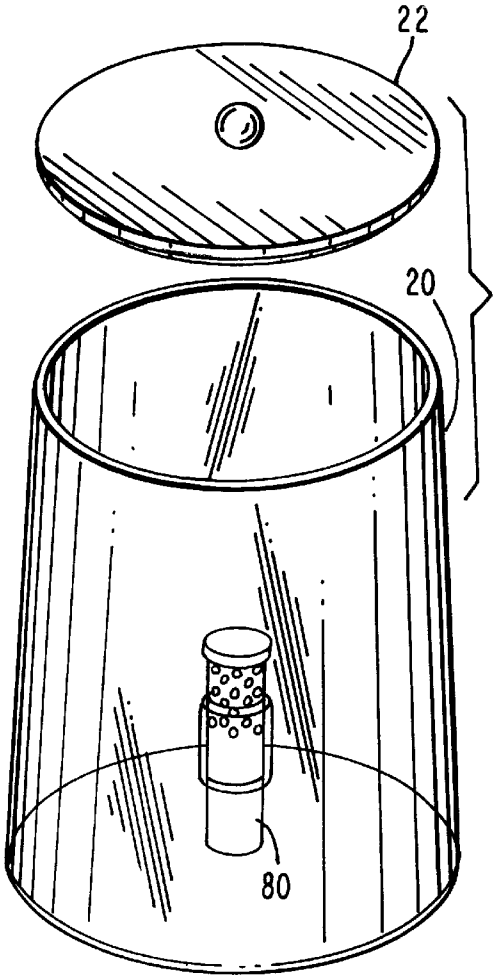
FIG. 7 is a view of the container of FIG. 5 with the element of FIG. 6, in accordance with the present invention.
Figure 6:
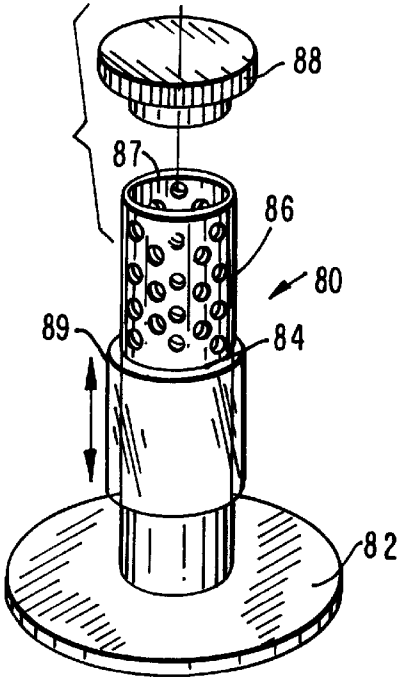
FIG. 6 is an exploded view of a humidification and flavoring element of the present invention which can be used in the container of FIG. 5.

FIG. 5 shows another embodiment of the invention where the air tight humidor is a LUCITE material, cylindrical canister 20 having an airtight lid 22. FIG. 6 illustrates an additive insert generally designated 80 which can be dropped into the canister 20 as shown in FIG. 7. Insert 80 comprises a disk base or support 82 and a central upstanding tube 84 having a lower, solid unperforated section and an upper section, approximately one third to one half the height of tube 82, which is perforated by a pattern of drilled holes 86. Tube 84 can be partly or completely filled with sponge or porous material and, through an upper open end 87, be filled with liquid such as a mixture of water and flavorant which saturates the sponge or other insert. A slidable sleeve 89 is closely engaged around the outer surface of tube 84 and can be slid upwardly to cover a selected number of holes 86 with more holes allowing more flavorant to escape from the tube and fewer holes blocking the escape for a slower insertion of flavorant into the canister atmosphere. Cap 88 is pressed on to opening 87 to close the top of the tube.

While specific embodiments of the invention have been shown and described in detail to illustrate the application of the principles of the invention, it will be understood that the invention may be embodied otherwise without departing from such principles.

What is claimed is:

1. A cigar enhancing humidor comprising:

a humidor container defining a storage space for tobacco products with interior nonporous walls;

means for air tightly closing the storage space;

means defining a chamber in said storage space;

an evaporable flavorant in said chamber; and control means connected to said chamber for controlling release of evaporating flavorant from said chamber into said storage space for imparting additional flavor to tobacco products in said container.

2. A humidor according to claim 1 wherein said control means comprise a pattern of perforations communicating an interior of said chamber with said storage space and moveable cover means movably mounted to said chamber for covering at least some of the perforations in said pattern of perforations.

3. A humidor according to claim 1 including a porous member in said chamber for absorbing flavorant.

4. A humidor according to claim 1 wherein said container is made of clear nonporous plastic material.

5. A humidor according to claim 1 wherein said container is cylindrical, said means for air tightly closing said container comprising a lid for closing said container, said chamber comprising a tube in said container.

6. A humidor according to claim 5 wherein said pattern of perforations is over only a portion of a length of said tube, said control means comprising a slide slidably mounted to said tube and over at least some perforations of said pattern of perforations.

7. A humidor according to claim 6 including a base connected to said tube for holding said tube upright in said container.

8. A humidor according to claim 7 including a porous element in said tube for absorbing flavorant to be released from said tube by evaporation.

9. A humidor according to claim 8 wherein said tube has an open end opposite from said base and a closure cap closing said open end.

10. A humidor according to claim 1 wherein said means defining a chamber comprises a cylindrical housing having one end carrying a pattern of perforations, said control means comprising a cover lid movably mounted to said housing and having a pattern of perforations substantially matching the pattern of perforations on said housing said lid being moveable to expose and cover perforations on said housing by selected amounts for adjusting evaporation of flavorant from said housing.

11. A humidor according to claim 10 including a porous element in said housing.

12. A humidor according to claim 11 including a spout connected to said housing for receiving flavorant into said housing and a cap for closing said spout.

13. A humidor according to claim 1 wherein said means defining a chamber comprises a pair of tubes, at least one passage communicating between said tubes, one of said tubes being perforated and at least one of said tubes containing a porous element, the tube which is not perforated being imperforate and receiving said flavorant.

14. A humidor according to claim 13 wherein each of said tubes has opposite ends, one of said ends being closed by caps and opposite ends being closed by corks.

15. A humidor according to claim 1 wherein said container comprises a box having multiple, mutually airtight compartments, at least one lid for closing said compartments, said chamber being in at least one of said compartments.

16. A humidor according to claim 15 including a hygrometer connected to said container for displaying a humidity in at least one of said compartments.

17. A humidor according to claim 1 wherein said flavorant is selected from the group consisting of extract and liquor.

18. A method of flavoring a cigar comprising placing the cigar in an airtight humidor container having nonporous walls; and slowly evaporating into said container, a flavorant and humidity for being absorbed into the cigar.

19. A method according to claim 18 wherein the flavorant is selected from the group consisting of extract and liquor.

20. A method according to claim 18 including evaporating the flavorant into the cigar over a period of three to ten days.

* * * * *